United States Patent [19]

Adini

[11] Patent Number: 4,833,961

[45] Date of Patent: May 30, 1989

[54] METHOD, DEVICE AND AMMUNITION FOR DISPERSING RIOTERS

[76] Inventor: Ari Adini, 104-20 Queens, Blvd., Forest Hills, N.Y. 11375

[21] Appl. No.: 155,995

[22] Filed: Feb. 16, 1988

[51] Int. Cl.[4] ..... F41F 1/04; F42B 11/00

[52] U.S. Cl. ..... 89/1.1; 102/357; 102/502; 102/503

[58] Field of Search ..... 89/1.11, 1.1; 124/56, 124/61, 71; 62/1; 426/100; D15/90; 169/52, 24; 102/502

[56] References Cited

U.S. PATENT DOCUMENTS

| | | | |
|---|---|---|---|
| D. 292,802 | 11/1987 | Fails | D15/90 |
| 2,098,753 | 11/1937 | Mulch | 62/1 |
| 3,586,236 | 6/1971 | Schaffler | 169/52 |
| 3,791,303 | 2/1974 | Sweeney et al. | 102/502 |
| 3,865,038 | 2/1975 | Barr | 102/502 |
| 3,921,980 | 11/1975 | Artzer | 273/428 |
| 4,086,902 | 5/1978 | Reynolds | 124/61 |
| 4,094,294 | 6/1978 | Speer | 124/56 |
| 4,154,012 | 5/1979 | Miller | 102/503 |
| 4,389,820 | 6/1983 | Fong et al. | 51/320 |
| 4,505,202 | 3/1985 | Fidler et al. | 102/357 |

OTHER PUBLICATIONS

"Red Hot Gadget Specials"; Woodies Catalogue, p. 11, May 4, 1986.

*Primary Examiner*—David H. Brown
*Attorney, Agent, or Firm*—Ilya Zborovsky

[57] ABSTRACT

For dispersing of rioters, an ammunition is used which includes a plurality of pieces of ice, which preferably, have a spherical shape and are fired at rioters by a firing equipment.

6 Claims, 1 Drawing Sheet

METHOD, DEVICE AND AMMUNITION FOR DISPERSING RIOTERS

BACKGROUND OF THE INVENTION

The present invention relates to a method, a device and an ammunition for dispersing riots.

The prevailing means for dispersing riots include tear gas, water spraying, rubber bullets. These means are widely used, however they provide only limited effect in dispersing rioting crowds. The reason is that the existing dispersing means effect only outer lines of rioters, while subsequent layers of the rioting crowds are not effected thereby. Also, the existing dispersing means do not immobilize the rioters.

SUMMARY OF THE INVENTION

Accordingly, it is an object of the present invention to provide a method, a device and an ammunition for dispersing rioters, which avoids the disadvantages of the prior art and are more effective than existing ones.

In keeping with these objects and with others which will become apparent hereinafter, one feature of the present invention resides, briefly stated, in a method of and a device for dispersing riots, as well as an ammunition therefor, in accordance with which a plurality of pieces of ice are fired on rioters, preferably at their feet.

In accordance with an advantageous feature of the present invention, the ice pieces are spherical in shape.

The direct impact of the ice pieces against the rioters is not lethal, at a controlled velocity. However, it is sufficient to cause pain. Rolling of the spherical ice pieces on the ground in large quantities will restrict the mobility of the rioters.

The novel features of the present invention are set forth in particular in the appended claims. The invention itself, however, both as to its construction and manner of operation, will be best understood from the following description of preferred embodiments which is accompanied by the following drawings.

DESCRIPTION OF PREFERRED EMBODIMENTS

Figure 2:
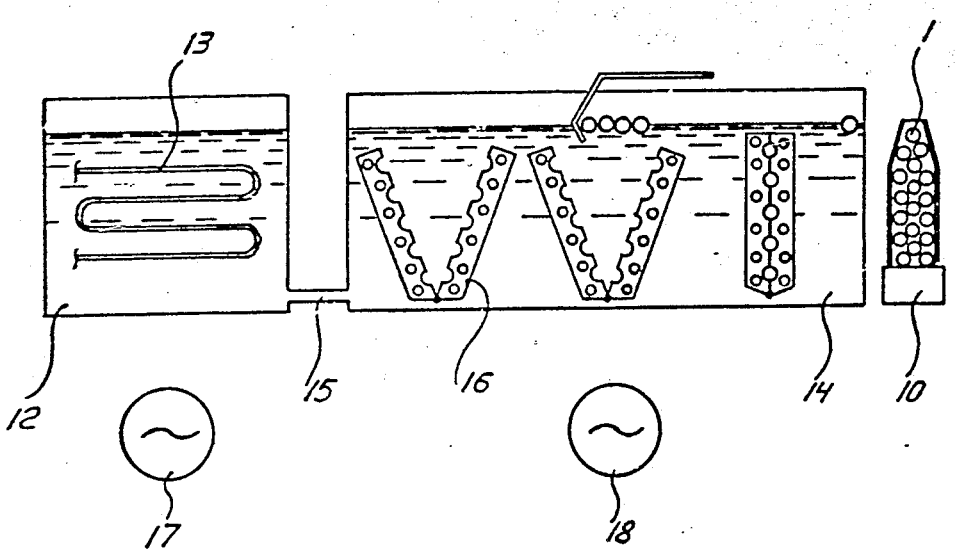
FIG. 2 is a view schematically showing equipment for producing the ammunition for dispersing rioters, in accordance with the present invention.
Figure 1:
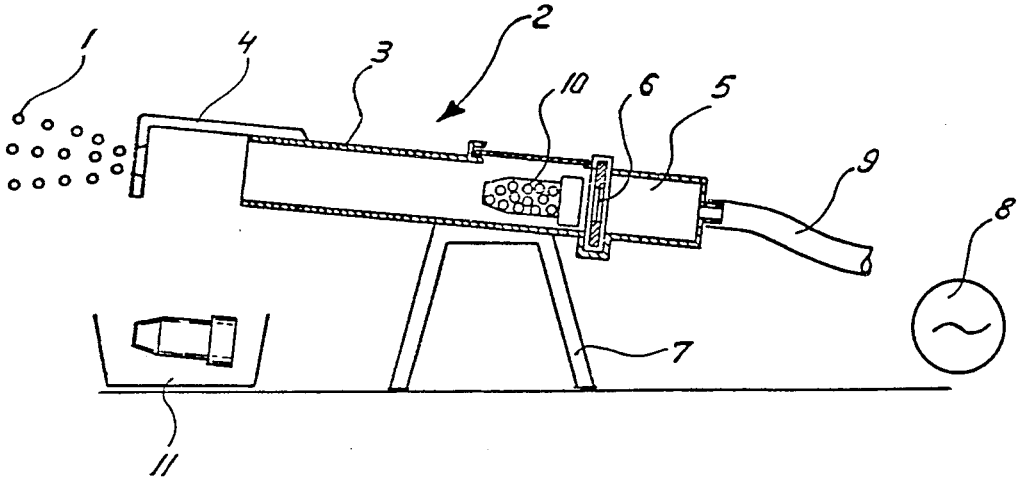
FIG. 1 is a view which schematically shows a device for firing an ammunition in accordance with the present invention, for dispersing rioters.

Dispersing of rioters in accordance with the present invention is performed by firing at the rioters a new ammunition which includes a plurality of pieces of ice 1. Preferable, the pieces of ice 1 have a spherical shape.

Firing equipment for firing the ice pieces includes a firing device 2 which has a barrel 3 with a retaining element 4, and a loading part 5. A diphragm 6 is located in the region between the loading part 5 and the barrel 3. The firing device has a conventional support 7 for firmly retaining the same on the ground. The firing equipment further includes a source of pressure medium 8 which is connected by a hose 9 with the loading part 5 of the firing device 2. The pressure medium source 8 can be formed as an air compressor with an adjustable air pressure.

The pieces of ice 1 are originally accommodated in small containers 10 which can be made of light plastic or cardboard. The container 10 with a plurality of ice pieces is loaded into the loading part 5, and the air compressor 8 is turned on so that it supplies the pressure air into the loading part 5, with a gradually increasing pressure. When the air pressure in the loading part 5 reaches a predetermined value, it opens the diaphragm and propels the container with the pieces of ice through the barrel and out of it. The retaining element 4 retains the container 10 so that it falls into a collector 11. The pieces of ice 1 in a dense pack continue their motion forward in direction toward rioters. For facilitating the separation of the container 10 from the pieces of ice 1, the container can be composed of two shells which easily open upon impact against the retaining element. On the other hand, they can open purely under the action of air which resists the motion forwardly of the container and enters the inner cavity of the container in its flight after firing.

The ammunition formed in accordance with the present invention, namely the pieces of ice 1, can be produced in the following manner. A supply of water is accommodated in a preliminary container 12 and cooled by a cooling element 13. The preliminary container 12 communicates with a main container 14 so that the cooled water flows into the latter through a connecting passage 15. Reference numerals 17,18 identify cooling compressor units. A plurality of openable and closeable plattens 16 are arranged in the main container 14. When the cooled water is supplied into the container 14 it fills the space between the open halves of each platten as well as semi-sperical openings of each half. Then the platten 16 closes and the water freezes in the spherical composite openings of the platten to form spherical pieces of ice. When then the platen opens again, the spherical pieces of ice float on the water surface and are collected from the latter to fill the container 10. Finally, the ice pieces producing equipment and the firing equipment can together form a contionuous line, such that the ice pieces are produced and immediately fired during rioting.

The invention is not limited to the details shown since various modifications and structural changes are possible without departing in any way from the spirit of the present invention.

What is desired to be protected by Letters patent in the method, device and ammunition of the present invention is set forth in particular in the appended claims.

I claim:

1. A method of dispersing rioters, comprising firing on rioters a plurality of rounds of ammunition formed as a plurality of pieces of ice which are initially accommodated in a container; and removing the container so as to release the ice pieces before reaching the rioters.

2. A device for dispersing riots and the like, comprising an ammunition including a plurality of pieces of ice accommodated in container; and means for firing said ammunition onto rioters and including means for removing said containers and exposing said ice pieces before reaching the rioters.

3. A device as defined in claim 2, wherein said means for firing includes means acting with a high pressure upon said ammunition and supplying a high pressure medium.

4. A device as defined in claim 3, wherein said high pressure acting means includes a compressor.

5. A device as defined in claim 2, and further comprising means for preparing said ammunition.

6. A device as defined in claim 5, wherein said preparing means includes a container with liquid, and openable and closable plattens arranged to be open for receiving the liquid and then to be closed to form said ice pieces therein.

* * * * *